US006794976B2

(12) United States Patent
Sigl

(10) Patent No.: US 6,794,976 B2
(45) Date of Patent: Sep. 21, 2004

(54) HF TRANSFORMER ASSEMBLY HAVING A HIGHER LEAKAGE INDUCTANCE BOOST WINDING

(75) Inventor: Dennis R. Sigl, Greenville, WI (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 10/248,181

(22) Filed: Dec. 24, 2002

(65) Prior Publication Data

US 2004/0119572 A1 Jun. 24, 2004

(51) Int. Cl.[7] ..... H01F 27/28

(52) U.S. Cl. ..... 336/170; 336/198; 336/192; 336/150; 219/670

(58) Field of Search ..... 336/65, 83, 137, 336/145, 150, 192, 198; 219/136–137 PS, 54, 617, 660–662, 670–672

(56) References Cited

U.S. PATENT DOCUMENTS 3,665,150 A * 5/1972 Mejia ..... 219/130.1
4,748,342 A * 5/1988 Dijkmans ..... 307/66
4,897,522 A 1/1990 Bilczo et al.
5,349,157 A * 9/1994 Blankenship ..... 219/130.32
5,351,175 A 9/1994 Blankenship
6,163,085 A 12/2000 Sigl et al.
6,369,680 B1 4/2002 Brinckmann et al.
6,611,189 B2 * 8/2003 Sigl ..... 336/198

FOREIGN PATENT DOCUMENTS

JP 54140923 A 11/1979

* cited by examiner

*Primary Examiner*—Tuyen T. Nguyen
(74) *Attorney, Agent, or Firm*—Ziolkowski Patent Solutions Group, LLC

(57) ABSTRACT

A high frequency transformer for a welding-type device is provided. The transformer includes a pair of ferrite cores and a bobbin configured to receive and support the pair of ferrite cores. A primary winding assembly, as well as, a secondary winding assembly is provided. The secondary winding assembly is in parallel with a center topped tertiary winding assembly. The tertiary winding assembly includes a number of coil sections such that each coil section is wrapped around an outer leg of a ferrite core.

23 Claims, 4 Drawing Sheets

HF TRANSFORMER ASSEMBLY HAVING A HIGHER LEAKAGE INDUCTANCE BOOST WINDING

BACKGROUND OF INVENTION

The present invention relates generally to welding-type devices and, more particularly, to a high frequency transformer having a higher leakage inductance boost winding.

Welding, cutting, and heating systems often require a step-down of the primary or input power for the welding, cutting, or heating application. That is, primary or input power is typically supplied to the welding, cutting, or heating system at voltages ranging from 110 to 575. However, the desired output voltage is typically much lower. Generally, transformers, rectifiers, and filters are used to convert the input power to usable power for the welding, cutting, or heating application.

A transformer is typically used to reduce or increase the voltage of incoming power so that it is usable for the particular welding, cutting, or heating application. Transformers are typically made up of a primary and secondary windings, or coils, around a metal core. As such, the primary voltage, or input voltage, enters the primary winding and creates a magnetic field that induces voltage in the secondary winding. The secondary winding then yields a voltage that is usable for the welding, cutting, or heating application. Typically, a simple turns ratio determines the secondary voltage. For example, by dividing the number of turns and the primary winding by the number of turns in a secondary winding will determine the amount by which the input voltage is stepped down by the transformer. For example, a primary winding having 120 turns and operable at 240 volts may have a corresponding secondary winding having 12 turns that yield or output 24 volts. As such, the input voltage is stepped down by ten-fold.

High frequency transformers are particularly applicable to inverter-controlled power sources. In an inverter-controlled environment, the incoming power is first rectified to DC and then filtered for smoothness. The filtered DC power is then sent through one or more IGBT that converts it back to AC but at a very high frequency. This high frequency alternating current is then stepped down or stepped up by a transformer in a manner similar to that described above. A rectifier and filter then rectify the stepped down AC signal to a DC signal and filter the DC signal to produce smooth usable output power, respectively.

Some welding, cutting, and heating applications require a step-up of the input power. That is, for efficient operation of the welding, cutting, or heating system, it may be necessary to increase or convert the input line voltage to a higher line voltage using a transformer or converter. Boost transformers can typically raise the line voltage in the range of 5% to 25%. With boost converters or transformers, it is desirable to maximize the output voltage while conserving primary current under higher output current conditions.

A number of transformer configurations have been developed to maximize the output voltage while conserving primary current. One exemplary approach included an output transformer having a core, primary windings, and a two-section secondary winding. The output transformer also includes a first auxiliary winding connected to one of the secondary sections to create an auxiliary current pulse as the core of the transformer is magnetized. The transformer also includes a second auxiliary winding connected to the other of the secondary sections to create a second auxiliary current pulse as the core is re-magnetized. In this exemplary embodiment, the auxiliary windings are connected in series with the secondary windings section. However, these auxiliary windings are in series with current control circuits including current-limiting inductors thereby increasing the cost as well as complexity of the transformer.

It would therefore be desirable to design a transformer having a boost winding that is constructed in such a manner as to eliminate the need for a separate inductor in series with the boost winding. It is also desirable to design a transformer assembly with improved part-to-part consistency.

BRIEF DESCRIPTION OF INVENTION

The present invention is directed to a high frequency transformer assembly having a boost winding with higher leakage inductance overcoming the aforementioned drawbacks. The present invention is particularly applicable for use with welding-type devices such as welders, plasma cutters, and induction heaters. The high frequency transformer has a primary winding, and preferably, two center tapped secondary or weld windings in parallel with a center tapped tertiary or boost winding. The two weld windings have half the turns ratio of the boost winding. All three windings are placed in parallel and together with a smoothing inductor form a welding output circuit. The aforementioned boost winding comprises four smaller sections such that each section resides on the outer legs of a ferrite E-core. Placement of the boost windings over the outer legs of the ferrite cores eliminates the need for a separate inductor in series with the boost winding. As indicated previously, a pair of secondary or welding windings are provided. Because two weld windings are used, the leakage inductance of the weld windings is reduced. Further, because the two weld windings carry an equal share of current, board-mounted discrete diodes may be used instead of more costly screw-top devices. The transformer also includes a bobbin designed to support the ferrite cores and the coil assemblies. Preferably, the bobbin includes a series of spacers that are used to guarantee consistent placement of the primary winding across the bobbin. This lowers the leakage inductance in the weld winding. Moreover, the spacers for the primary winding guarantee part-to-part consistency.

Therefore, in accordance with one aspect of the present invention, a high frequency transformer for a welding-type device is provided. The transformer includes a pair of ferrite cores and a bobbin configured to receive and support the pair of ferrite cores. A primary winding assembly, as well as, a secondary winding assembly is provided. The secondary winding assembly is in parallel with a center topped tertiary winding assembly. The tertiary winding assembly includes a number of coil sections such that each coil section is wrapped around an outer leg of a ferrite core.

In accordance with yet another aspect of the present invention, an apparatus configured to manage and condition power for a welding-type device includes a housing forming an enclosure having a fore end and an aft end. The apparatus includes a front panel connected to the housing at the fore end and a rear panel connected to the housing at the aft end. A plurality of electrical components is disposed within the enclosure wherein the components include a transformer assembly. The transformer assembly includes a pair of multi-pole ferrite cores and a bobbin configured to receive and support the ferrite cores. The transformer assembly also includes a primary winding, at least one weld winding, and a boost winding. The windings are in electrical parallel and collectively form a welding output circuit. The boost winding includes a number of sections such that each section is positioned over an outer pole of a ferrite core. The apparatus further includes a cable extending through the rear panel and configured to supply raw power to the apparatus.

In accordance with a further aspect of the present invention, a kit for retrofitting a transformer assembly of a welding-type device is provided. The kit includes a pair of multi-pole ferrite cores and a bobbin configured to support the pair of multi-pole ferrite cores. A primary winding as well as at least one weld winding is also provided. The kit further includes a boost winding having a number of coil sections wherein each coil section is configured to be positioned around an outer pole of a ferrite core.

Various other features, objects and advantages of the present invention will be made apparent from the following detailed description and the drawings.

BRIEF DESCRIPTION OF DRAWINGS

The drawings illustrate one preferred embodiment presently contemplated for carrying out the invention.

In the drawings.

DETAILED DESCRIPTION

The present invention is directed to a transformer assembly that is particularly applicable as a boost converter in a welding-type device such as a gas tungsten arc welding (GTAW) system similar to the Maxstar series of systems marketed by the Miller Electric Manufacturing Company of Appleton, Wis. Maxstar is a registered trademark of Miller Electric Manufacturing Company of Appleton, Wis.

Figure 1:
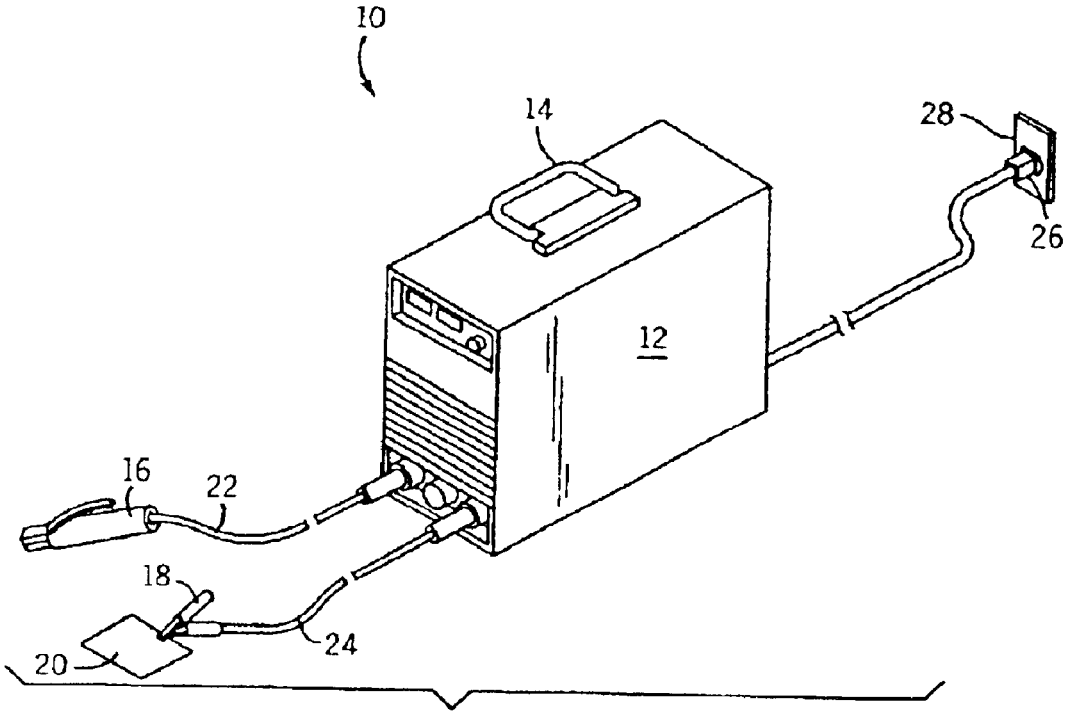
FIG. 1 is a perspective view of a welding-type device in accordance with the present invention.

Referring now to FIG. 1, a perspective view of a welding device incorporating the present invention is shown. Welding device 10 includes a housing enclosing the internal components of the welding device including a transformer assembly with a boost winding as will be described in greater detail below. Optionally, the welding device 10 includes a handle 14 for transporting the welding system from one location to another. To effectuate the welding process, the welding device includes a torch 16 as well as a clamp 18. Clamp 18 is configured to hold a workpiece 20 to be welded. As is known, when torch 16 is in relative proximity to workpiece 20, a welding or cutting arc, depending upon the particular welding-type device, results. Connecting the torch 16 and clamp 18 to the housing 12 is a pair of cables 22 and 24, respectively.

As indicated previously, housing 12 forms an enclosure having therein a plurality of electrical components. The housing and components collectively form a power source for the welding device. The power source conditions raw power received from a utility line power supply or from an engine driven power supply and conditions that power for use by the welding application. As such, welding device 10 includes cable 26 that provides power to the plurality of electrical components within housing 12 from a line power supply 28. Alternatively, cable 26 may be connected to an engine driven power supply, battery, or other power supplying system.

Power sources must convert a power or voltage input to a necessary or desirable power output tailored for a specific application. For example, in a welding application, the power source typically receives a high voltage (230/240) volt alternating current (VAC) signal and provides a high current output welding signal. Moreover, the input sources may be single-phase or three-phase. Welding power sources receive the power input and produce approximately 10–40 VDC high current welding output. For some applications, it is desirable for the power source to output a power signal at a voltage level greater than the input voltage level. In these applications, a step-up transformer is commonly used. To further maximize the output voltage of the power source, the transformer may include a boost winding.

Figure 2:
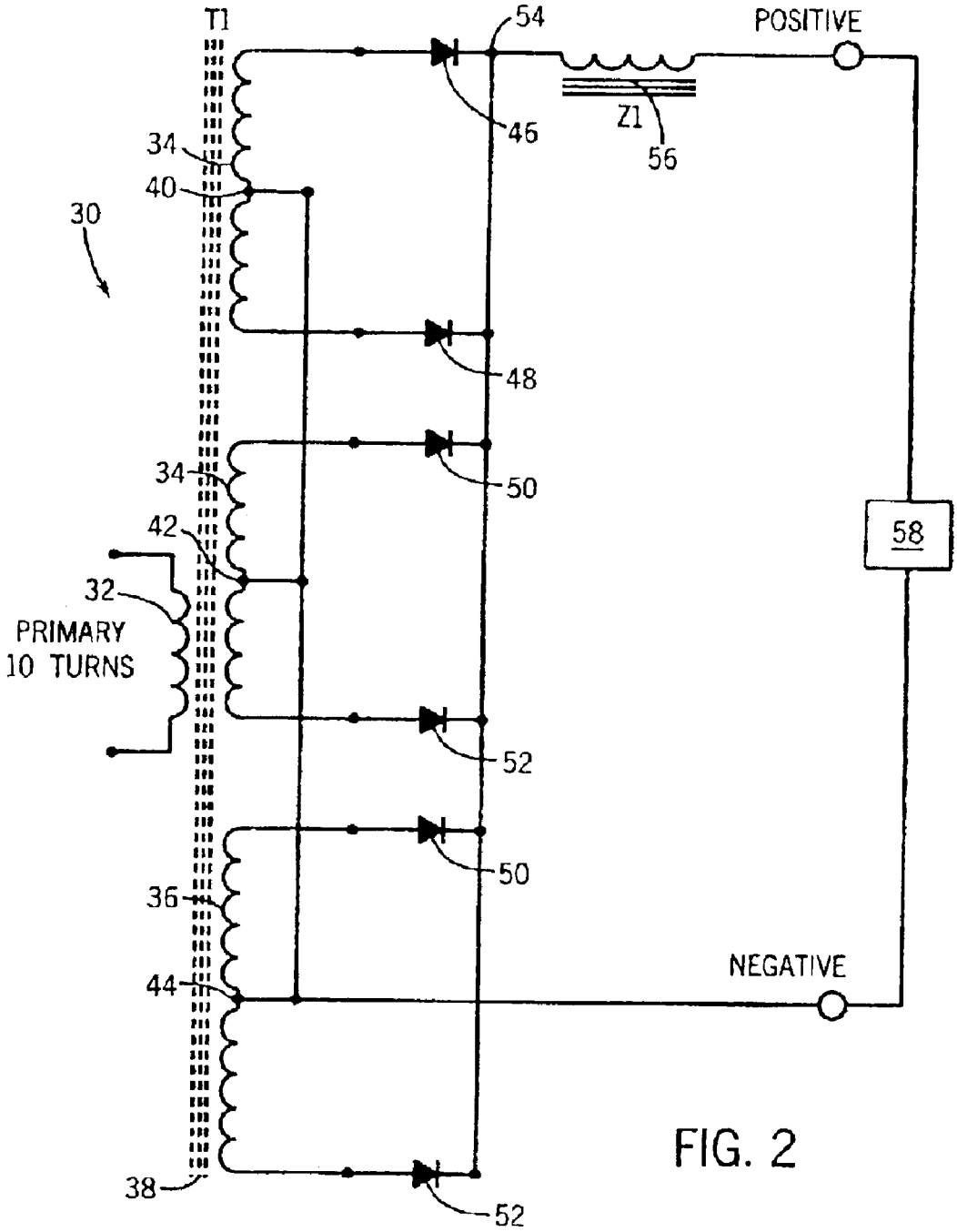
FIG. 2 is a schematic wiring diagram of the windings of a transformer in accordance with the present invention.

Referring now to FIG. 2, a schematic wiring diagram illustrating the windings of a high frequency transformer in accordance with the present invention is shown. The transformer 30 includes a primary winding 32, a pair of weld windings 34, and a boost winding 36. In high frequency applications, a single primary winding may be used to magnitize and remagnitize core structure 38. Transformer 30 is located electrically downstream from a bridge rectifier and filter network (not shown). The bridge rectifier and filter network receive a raw three-phase power signal as input and develop a DC output. Various switches (now shown) may also be employed to regulate the magnetization and demagnetization of core structure 38.

This alternating magnetization and re-magnetization of the core induces voltage in the secondary or weld windings 34. As shown, each weld winding 34 as well as boost winding 36 are center tapped at junctions 40–44, respectively. Additionally, each weld winding 34 and boost winding 36 include a pair of diodes 46–52. It should be noted that the diodes for the boost winding are the same as the diodes for one of the secondary or weld windings. Diodes 46–52 are rectifying diodes that cause a DC output for the welding application. Pulses of current between junction 54 and center tapped junctions 40–44 are filtered through a standard choke 56 and applied across a welding station 58.

Figure 3:
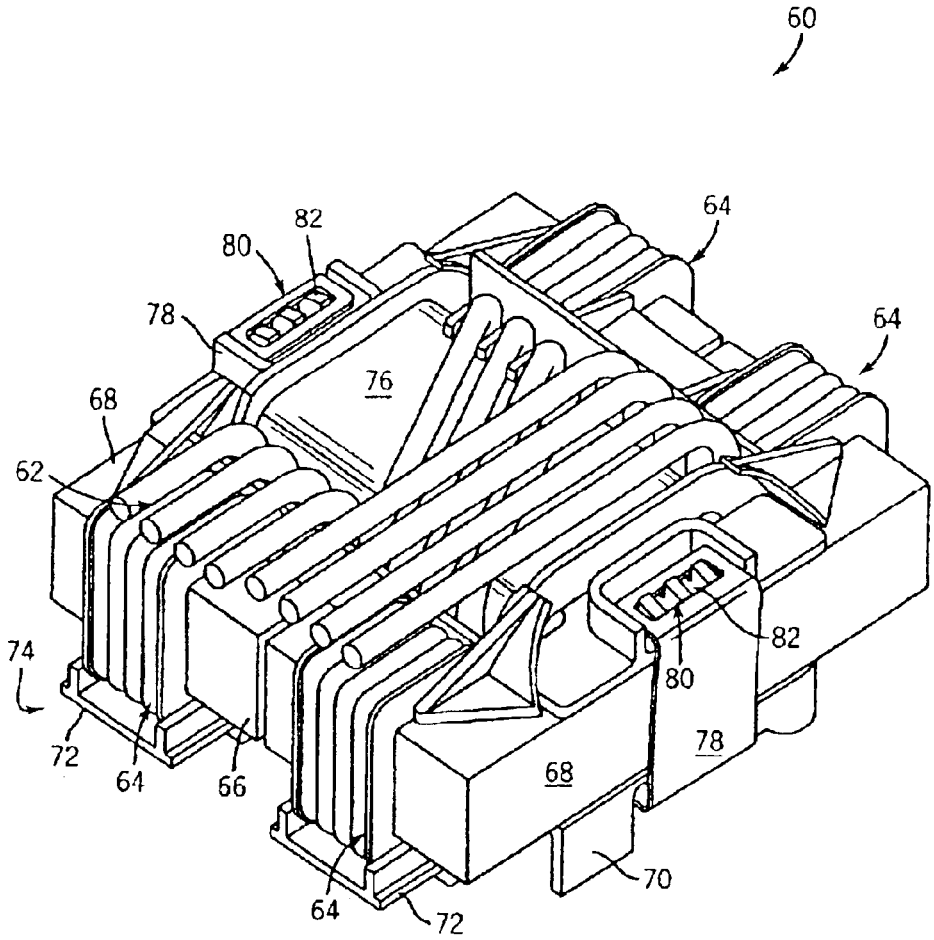
FIG. 3 is a perspective view of an assembled transformer in accordance with the present invention.

Referring now to FIG. 3, a high frequency transformer having a higher leakage inductance boost winding is shown. Transformer 60 includes a primary winding (not shown), a weld winding 62, and a boost winding 64. Boost winding 64 includes four coil sections such that each coil section is positioned around an outer leg 66 of an E-shaped ferrite core 68. The primary winding and the weld windings as well as the pair of ferrite cores are supported by a bobbin 70. Preferably, bobbin 70 is fabricated from a lightweight plastic but could also be formed from other non-conductive materials. Supporting each section of the boost winding is a flange 72 of a secondary shroud 74. As will be described in detail with respect to FIG. 4, transformer 60 includes a pair of secondary shrouds 74. Disposed between the weld windings 62 and the primary winding is an insulator 76. A pair of spring clips 78 is then used to secure the E-cores and the bobbin together. Preferably, each clip is fabricated from spring temper brass material or non-magnetic stainless steel to reduce eddy current heating. Each clip includes a pair of holes 80 configured to receive a ramp portion 82 or other protrusion located on the top and bottom surfaces of each end of the bobbin. The ramps include a shoulder and filet that provides an engagement point with the spring clips thereby eliminating a stress concentration on the ferrite core directly. This ramp/clip combination avoids a potentially damaging bending moment that would otherwise be caused by a force acting on the core from the clip. Additionally, the bobbin is preferably fabricated from a moldable material that is extremely stiff and strong when exposed to high temperatures.

Figure 4:
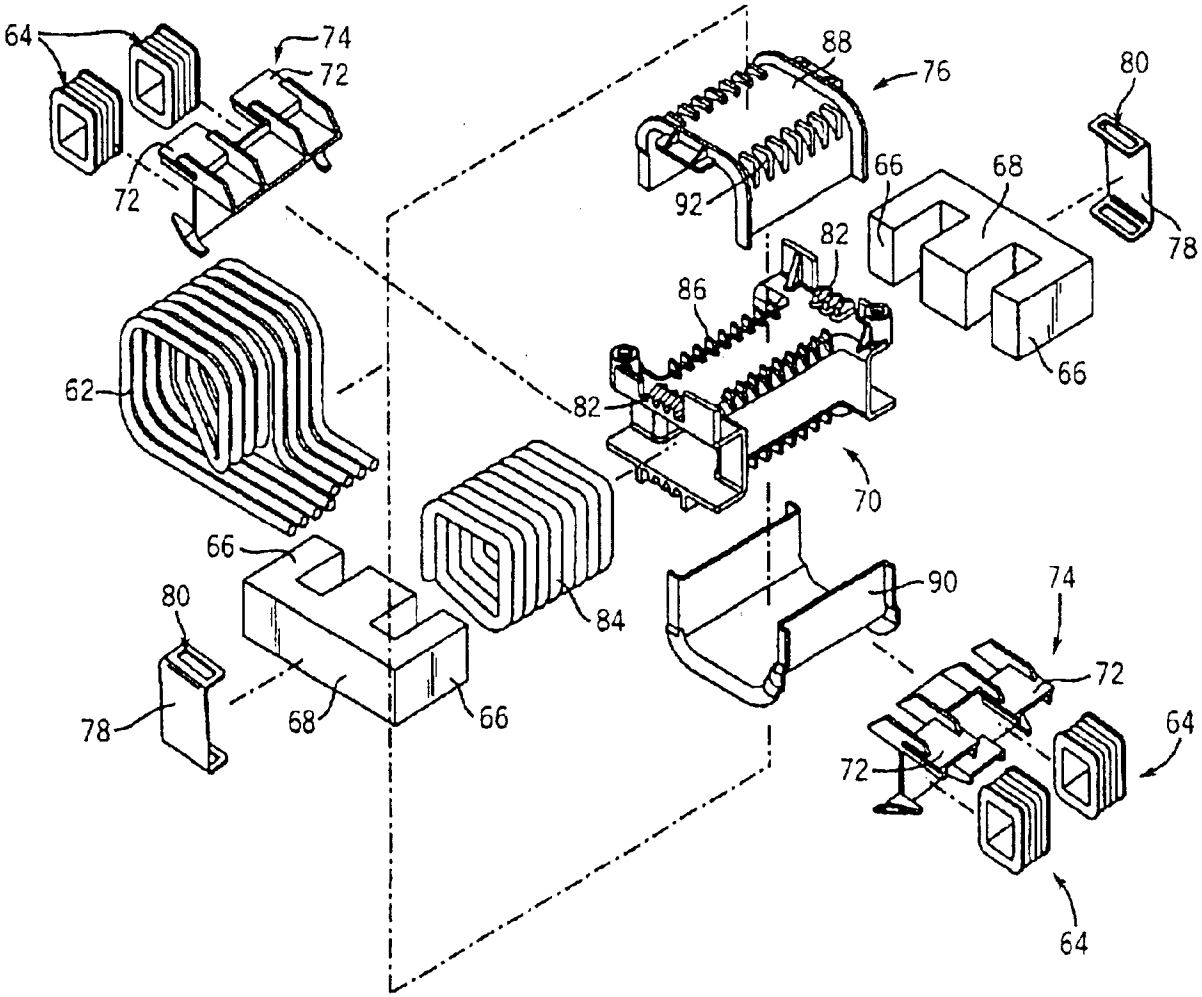
FIG. 4 is an exploded view of that shown in FIG. 3.

Referring now to FIG. 4, an exploded view of the transformer is shown. Positioned centrally within the transformer 60 is the molded bobbin 70. Wrapped around bobbin 70 is the primary winding 84. Bobbin 70 includes a series of spacers 86 such that consecutive spacers form a groove to receive a portion of the primary winding 84. As such, a consistent spacing of the primary winding about the bobbin 70 may be achieved. Simply, the spacers spread the primary turns of the primary winding evenly over the width of the bobbin 70. By spreading the primary winding to extend along the entire width of the bobbin 70, the leakage inductance to the weld the winding 62 is lowered.

Positioned over the primary winding 84 is insulator assembly 76. As shown, insulator assembly 76 includes a first portion 88 and a second portion 90. Each portion 88, 90 is then placed around the bobbin 70 and connected to one another. The top surface 88 of insulator assembly 76 includes a series of spacers or ridges 92. Spacers 92 work similarly to spacers 86 of the bobbin in that consecutive spacers provide a groove for receiving wire of the weld winding. As such, consistent spacing of the weld winding 62 around the insulator is achieved. Insulator 76 operates to insulate the primary winding 84 from the weld windings 62.

Weld winding assembly 62 includes a pair of weld windings. The pair of weld windings has a reduced leakage inductance when compared to a single winding having a larger diameter. Moreover, the use of two smaller wires for the weld winding assembly 62 decreases the width of the transformer 60. This can be important for packaging considerations. Moreover, two smaller weld windings carry less current, so a cheaper board-mounted discrete diode (not shown) may be used instead of a more expensive screwtop device.

Placed over the weld winding assembly 62 are secondary shrouds 74. The secondary shrouds include flanges 72 that operate to prevent the boost winding sections 64 from moving. Moreover, the flanges 72 maximize the distance, and as a result, the leakage inductance of the boost winding with respect to the primary winding.

Placed over the outer legs 66 of the ferrite E-core are coil sections of a boost winding 64. Preferably, the boost winding includes four coil sections corresponding to the four outer poles or legs of the pair of E-shaped cores. The four coil sections are in series and one-half of the center tap for the boost is on one side of the bobbin and the other half of the center tap is on the other side of the bobbin. As a result, two of the same diodes used for the weld windings assembly may be used for the boost winding. As a result, a four diode full wave rectifier and an external inductor are not required. Because the weld and boost windings are center tapped, only two diodes are needed for each winding. Additionally, the boost winding has twice the turns ratio of the pair of weld windings. Once the coil sections of the boost winding are properly positioned, spring clips 78 are used to secure the transformer assembly into one integral structure. As was described with respect to FIG. 3, clips 78 include a hole or slot 80 configured to receive a corresponding ramp portion of the bobbin to secure the assembly.

Therefore, in accordance with one embodiment of the present invention, a high frequency transformer for a welding-type device is provided. The transformer includes a pair of ferrite cores and a bobbin configured to receive and support the pair of ferrite cores. A primary winding assembly, as well as, a secondary winding assembly is provided. The secondary winding assembly is in parallel with a center topped tertiary winding assembly. The tertiary winding assembly includes a number of coil sections such that each coil section is wrapped around an outer leg of a ferrite core.

In accordance with yet another embodiment of the present invention, an apparatus configured to manage and condition power for a welding-type device includes a housing forming an enclosure having a fore end and an aft end. The apparatus includes a front panel connected to the housing at the fore end and a rear panel connected to the housing at the aft end. A plurality of electrical components is disposed within the enclosure wherein the components include a transformer assembly. The transformer assembly includes a pair of multi-pole ferrite cores and a bobbin configured to receive and support the ferrite cores. The transformer assembly also includes a primary winding, at least one weld winding, and a boost winding. The windings are in electrical parallel and collectively form a welding output circuit. The boost winding includes a number of sections such that each section is positioned over an outer pole of a ferrite core. The apparatus further includes a cable extending through the rear panel and configured to supply raw power to the transformers assembly.

In accordance with a further embodiment of the present invention, a kit for retrofitting a transformer assembly of a welding-type device is provided. The kit includes a pair of multi-pole ferrite cores and a bobbin configured to support the pair of multi-pole ferrite cores. A primary winding as well as at least one weld winding is also provided. The kit further includes a boost winding having a number of coil sections wherein each coil section is configured to be positioned around an outer pole of a ferrite core.

The present invention has been described in terms of the preferred embodiment, and it is recognized that equivalents, alternatives, and modifications, aside from those expressly stated, are possible and within the scope of the appending claims.

What is claimed is:

1. An HF transformer for a welding-type device comprising:

a pair of ferrite cores;

a bobbin configured to receive and support the pair of ferrite cores;

a primary winding assembly;

a secondary winding assembly in parallel with a center tapped tertiary winding assembly; and wherein the tertiary winding assembly includes a number of coil sections such that each coil section is wrapped around an outer leg of a ferrite core.

2. The HF transformer of claim 1 wherein the secondary winding assembly includes a first secondary winding and a second secondary winding.

3. The HF transformer of claim 1 wherein the bobbin includes a series of spacers such that consecutive spacers form a groove configured to receive a portion of the primary winding assembly.

4. The HF transformer assembly of claim 3 wherein the spacers are placed equidistant from one another along the bobbin to ensure equal spacing of wire of the primary winding assembly.

5. The HF transformer assembly of claim 1 further comprising at least one pair of board-mounted diodes to regulate the secondary winding assembly.

6. The HF transformer assembly of claim 1 further comprising an insulator assembly disposed between the primary winding assembly and the secondary winding assembly.

7. The HF transformer assembly of claim 6 further comprising a shroud disposed between the secondary winding assembly and the center tapped tertiary winding assembly.

8. The HF transformer assembly of claim 7 wherein the shroud includes a flange disposed in an inside and an outside of the bobbin to prevent movement of the winding assemblies.

9. The HF transformer assembly of claim 8 wherein the flange is constructed to optimize a length with respect to the primary winding assembly in order to maximize leakage inductance of the boost winding with respect to the primary winding assembly.

10. An apparatus configured to manage and condition power for a welding-type device, the apparatus comprising:

a housing forming an enclosure having a fore end and an aft end;

a front panel connected to the housing at the fore end and a rear panel connected to the housing at the aft end;

a plurality of electrical components disposed within the enclosure, the plurality of electrical components including a transformer assembly, the transformer assembly including:

a pair of multi-pole ferrite cores;

a bobbin configured to receive and support the ferrite cores;

a primary winding, at least one weld winding, and a boost winding; wherein the windings are in electrical parallel and collectively form a welding output circuit, and wherein the boost winding includes a number of sections such that each section is positioned over an outer pole of a ferrite core; and a cable extending through the rear panel and configured to supply raw power to the apparatus.

11. The apparatus of claim 10 wherein the multi-pole ferrite cores have an E-shape and wherein each section of the boost winding is positioned over an outer leg of an E-shaped ferrite core.

12. The apparatus of claim 10 wherein the at least one weld winding includes a first weld winding and a second weld winding.

13. The apparatus of claim 10 wherein the plurality of electrical components includes a circuit card assembly having circuitry to regulate the transformer assembly, the circuit card assembly including a discrete diode mounted thereto to regulate voltage in the at least one weld winding.

14. The apparatus of claim 10 wherein the bobbin includes a number of spacers along an outer surface thereof wherein consecutive spacers form a groove to receive wire of the primary winding.

15. The apparatus of claim 14 wherein the spacers are equidistantly arranged along the outer surface and are arranged to ensure primary winding wire coverage along an entire length of the bobbin.

16. The apparatus of claim 10 wherein the boost winding is center tapped and wherein the transformer assembly further includes an insulating shroud disposed between the at least one weld winding and the boost winding.

17. The apparatus of claim 16 wherein the shroud includes a flange configured to optimize a length with respect to the primary winding in order to maximize leakage inductance of the boost winding with respect to the primary winding.

18. The apparatus of claim 10 wherein the transformer assembly includes an insulator disposed between the primary winding and the at least one weld winding.

19. A kit for retrofitting a transformer assembly of a welding-type device, the kit comprising:

a pair of multi-pole ferrite cores;

a bobbin configured to support the pair of multi-pole ferrite cores;

a primary winding;

at least one weld winding; and a boost winding having a number of coil sections, wherein each coil section is configured to be positioned around an outer pole of a ferrite core.

20. The kit of claim 19 wherein the bobbin includes a series of spacers equidistant from one another along an outer surface of the bobbin such that consecutive spaces define a groove configured to receive wire of the primary winding.

21. The kit of claim 19 further comprising an insulator to place between the primary winding and the at least one weld winding and further comprising a shroud to place between the at least one weld winding and the boost winding.

22. The kit of claim 19 wherein the multi-pole ferrite cores have an E-shape and the boost winding includes four coil sections such that each coil section is positioned around an outer leg of a ferrite core.

23. The kit of claim 19 wherein the at least one weld winding includes a first and a second weld winding and wherein the first and the second weld windings have half the turns ratio of the boost winding.

* * * * *